US010899565B2

(12) United States Patent
Terao

(10) Patent No.: US 10,899,565 B2
(45) Date of Patent: Jan. 26, 2021

(54) PAPER FEED APPARATUS AND IMAGE FORMING APPARATUS

(71) Applicants: KABUSHIKI KAISHA TOSHIBA, Tokyo (JP); TOSHIBA TEC KABUSHIKI KAISHA, Tokyo (JP)

(72) Inventor: Yasunobu Terao, Izunokuni Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/572,770

(22) Filed: Sep. 17, 2019

(65) Prior Publication Data

US 2020/0010293 A1 Jan. 9, 2020

Related U.S. Application Data

(63) Continuation of application No. 15/447,500, filed on Mar. 2, 2017, now Pat. No. 10,421,629.

(51) Int. Cl.
*B65H 3/06* (2006.01)
*B65H 1/04* (2006.01)
(Continued)

(52) U.S. Cl.
CPC ..... *B65H 3/0684* (2013.01); *B65H 1/04* (2013.01); *B65H 1/266* (2013.01); *B65H 3/0623* (2013.01);
(Continued)

(58) Field of Classification Search
CPC ... B65H 3/54; B65H 3/56; B65H 3/60; B65H 2301/51212; B65H 3/5223; B65H 2405/1136
See application file for complete search history.

(56) References Cited

U.S. PATENT DOCUMENTS 3,405,936 A 10/1968 Puckette et al.
3,425,685 A 2/1969 Liva
(Continued)

OTHER PUBLICATIONS

Non-Final Office Action for U.S. Appl. No. 15/447,500 dated Jun. 30, 2017.
(Continued)

*Primary Examiner* — Jeremy R Severson
(74) *Attorney, Agent, or Firm* — Amin, Turocy & Watson, LLP

(57) ABSTRACT

A paper feed apparatus comprises a paper feed section, a separation section, a rotating body and a control device. The paper feed section feeds an image receiving medium that is placed. The separation section is arranged at a downstream side of the paper feed section in a conveyance direction of the image receiving medium. If a plurality of the image receiving media fed from the paper feed section is overlapped, the separation section separates the plurality of the image receiving media that is overlapped. The rotating body is arranged at the upstream side of the separation section in the conveyance direction of the image receiving medium. The rotating body is capable of contacting with the placed image receiving medium. The rotating body is rotatable. The control device carries out control to rotate the rotating body at least before an operation of the paper feed section.

12 Claims, 14 Drawing Sheets

(51) Int. Cl.

| | |
|---|---|
| ***B65H 1/26*** | (2006.01) |
| ***B65H 3/56*** | (2006.01) |
| ***B65H 3/52*** | (2006.01) |
| ***G03G 15/00*** | (2006.01) |

(52) U.S. Cl.

CPC ..... *B65H 3/5215* (2013.01); *B65H 3/56* (2013.01); *G03G 15/6555* (2013.01); *B65H 2301/51212* (2013.01); *B65H 2404/1116* (2013.01); *B65H 2405/1136* (2013.01); *B65H 2801/06* (2013.01)

(56) References Cited

U.S. PATENT DOCUMENTS

| | | | | |
|---|---|---|---|---|
| 4,463,943 | A * | 8/1984 | Deconinck | B65H 3/02 271/115 |
| 5,915,682 | A | 6/1999 | Ambuhl et al. | |
| 6,488,277 | B2 | 12/2002 | Herrmann | |
| 6,715,750 | B1 | 4/2004 | Gerlier et al. | |
| 7,159,861 | B2 | 1/2007 | Duesterhus | |
| 7,748,701 | B2 | 7/2010 | Gustafsson et al. | |
| 8,430,392 | B2 * | 4/2013 | Nada | B41J 13/103 271/10.11 |
| 8,733,755 | B2 | 5/2014 | Taniguchi | |

OTHER PUBLICATIONS

Final Office Action for U.S. Appl. No. 15/447,500 dated Dec. 27, 2017.

Non-Final Office Action for U.S. Appl. No. 15/447,500 dated Jun. 28, 2018.

Final Office Action for U.S. Appl. No. 15/447,500 dated Jan. 14, 2019.

* cited by examiner

PAPER FEED APPARATUS AND IMAGE FORMING APPARATUS

CROSS-REFERENCE TO RELATED APPLICATIONS

This application is a Continuation of application Ser. No. 15/447,500 filed on Mar. 2, 2017, the entire contents of which are incorporated herein by reference.

FIELD

Embodiments described herein relate generally to a paper feed apparatus, an image forming apparatus, and methods associated therewith.

BACKGROUND

Conventionally, there is a paper feed apparatus for sequentially feeding a plurality of laminated image receiving media towards a conveyance path. The paper feed apparatus is provided with a pickup roller, a pair of rollers and a fixed friction section. The pickup roller sends out the plurality of the laminated image receiving media in order towards the conveyance path. The pair of rollers is arranged at the downstream side of the pickup roller in a conveyance direction of the image receiving medium. The pair of rollers is composed of a paper feed roller and a separation roller. An inclined section which is inclined in such a manner that a downstream side part thereof in the conveyance direction is positioned at an upper side is arranged between the pickup roller and the pair of rollers in the conveyance direction of the image receiving medium. The fixed friction section is fixed to a fixed position of the inclined section. The fixed friction section applies a friction force to the image receiving medium sent out from the pickup roller. However, there is a case in which the plurality of the image receiving media that is overlapped cannot be separated from each other by the fixed friction section according to a coefficient of friction between the image receiving media and a surface state of the image receiving medium. In this case, if the plurality of the image receiving media that is overlapped is conveyed to the pair of rollers, there is a possibility that the plurality of the image receiving media cannot be separated by the separation roller and double feeding occurs.

DETAILED DESCRIPTION

Figure 1:
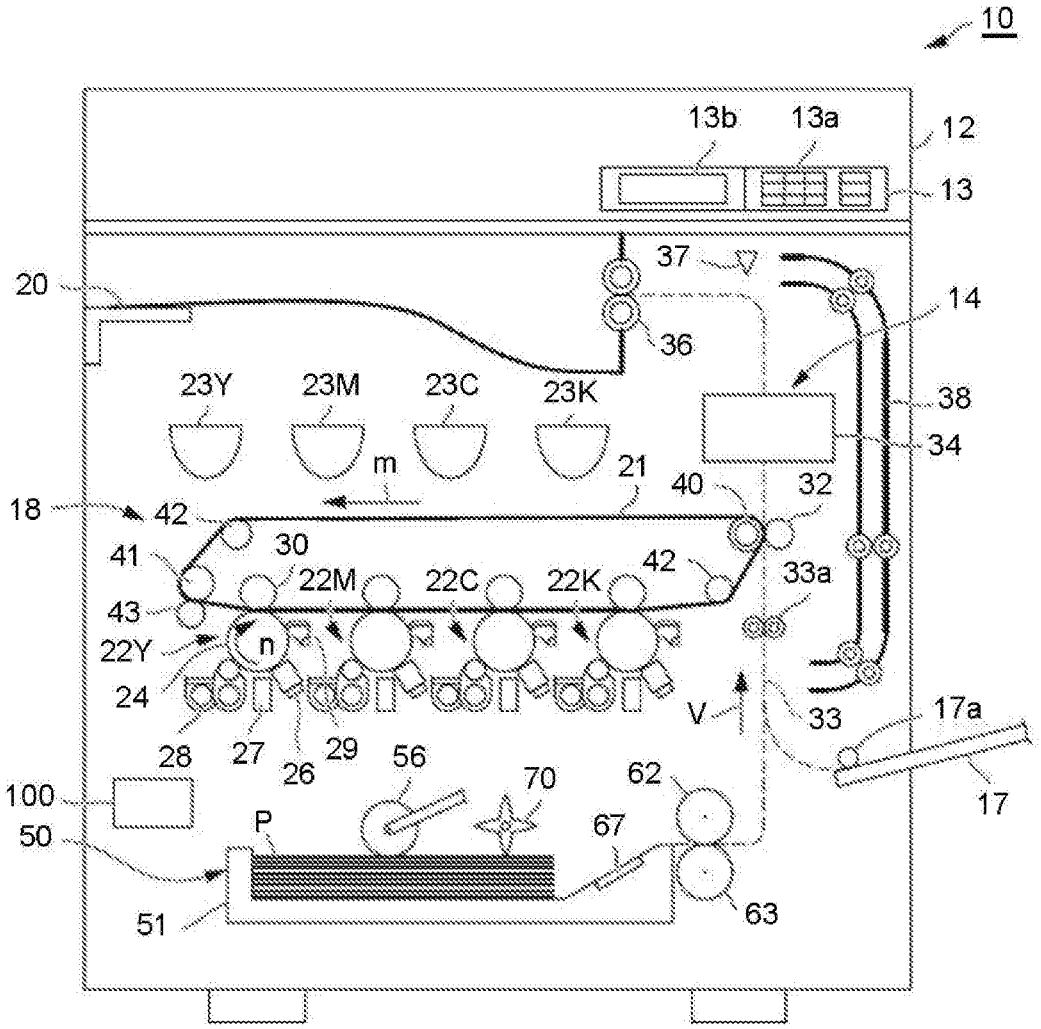
FIG. 1 is a side view illustrating an example of an image forming apparatus according to an embodiment.

In accordance with an embodiment, a paper feed apparatus comprises a paper feed section, a separation section, a rotating body and a control device. The paper feed section feeds an image receiving medium that is placed. The separation section is arranged at the downstream side of the paper feed section in a conveyance direction of the image receiving medium. In a case in which a plurality of the image receiving media fed from the paper feed section is overlapped, the separation section separates the plurality of the image receiving media that is overlapped. The rotating body is arranged at the upstream side of the separation section in the conveyance direction of the image receiving medium. The rotating body is capable of contacting with the placed image receiving medium. The rotating body is rotatable. The control device carries out control to rotate the rotating body at least before an operation of the paper feed section.

Hereinafter, an image forming apparatus 10 of an embodiment is described with reference to the accompanying drawings. Furthermore, in each diagram, the same components are donated with the same reference numerals.

FIG. 1 is a side view illustrating an example of the image forming apparatus 10 according to the embodiment. Hereinafter, an MFP 10 is described as an example of the image forming apparatus 10.

The MFP 10 includes a scanner 12, a control panel 13 and a main body section 14. The scanner 12, the control panel 13 and the main body section 14 each are provided with a controller. The MFP 10 includes a system controller 100 for collectively controlling each controller. The main body section 14 is provided with a paper feed apparatus 50 and a printer section (image forming section).

The scanner 12 reads a document image. The control panel 13 includes input keys 13*a* and a display section 13*b*. For example, the input keys 13*a* receive an input by a user. For example, the display section 13*b* is a touch panel type. The display section 13*b* receives an input by the user to display the input to the user.

The paper feed apparatus 50 includes a paper feed cassette 51 and a pickup roller 56. The paper feed cassette 51 houses a sheet-like image receiving medium (hereinafter, referred to as a "sheet") such as a paper. The pickup roller 56 takes out the sheet P from the paper feed cassette 51.

The paper feed cassette 51 feeds an unused sheet P. The sheet feed apparatus 50 supplies the sheet P towards the printer section 18. The paper feed tray 17 feeds the unused sheet P with a pickup roller 17*a*.

The printer section 18 forms an image. For example, the printer section 18 executes image formation of the document image read with the scanner 12. The printer section 18 is provided with an intermediate transfer belt 21. The printer section 18 supports the intermediate transfer belt 21 with a backup roller 40, a driven roller 41 and a tension roller 42. The backup roller 40 is provided with a drive section (not shown). The printer section 18 rotates the intermediate transfer belt 21 in an arrow m direction.

The printer section 18 includes 4 sets of image forming stations 22Y, 22M, 22C and 22K. The image forming stations 22Y, 22M, 22C and 22K are used to form Y (yellow), M (magenta), C (cyan) and K (black) images, respectively. The image forming stations 22Y, 22M, 22C and 22K are arranged in parallel below the intermediate transfer belt 21 along a rotation direction of the intermediate transfer belt 21.

The printer section 18 includes cartridges 23Y, 23M, 23C and 23K over the image forming stations 22Y, 22M, 22C and 22K. The cartridges 23Y, 23M, 23C and 23K store Y (yellow), M (magenta), C (cyan) and K (black) toner for replenishment, respectively.

Hereinafter, among the image forming stations 22Y, 22M, 22C and 22K, the image forming station 22Y of Y (yellow) is described as an example. Furthermore, as the image forming stations 22M, 22C and 22K have the same structure as the image forming station 22Y, the detailed description thereof is omitted.

The image forming station 22Y includes an electrostatic charger 26, an exposure scanning head 27, a developing device 28 and a photoconductor cleaner 29. The electrostatic charger 26, the exposure scanning head 27, the developing device 28 and the photoconductor cleaner 29 are arranged in the vicinity of the photoconductive drum 24 rotating in an arrow n direction.

The image forming station 22Y is provided with a primary transfer roller 30. The primary transfer roller 30 faces the photoconductive drum 24 across the intermediate transfer belt 21.

The image forming station 22Y exposes the photoconductive drum 24 with the exposure scanning head 27 after the photoconductive drum 24 is charged by the electrostatic charger 26. The image forming station 22Y forms an electrostatic latent image on the photoconductive drum 24. The developing device 28 uses a two-component developing agent composed of the toner and a carrier to develop the electrostatic latent image on the photoconductive drum 24.

The primary transfer roller 30 primarily transfers a toner image formed on the photoconductive drum 24 onto the intermediate transfer belt 21. The image forming stations 22Y, 22M, 22C and 22K form a color toner image on the intermediate transfer belt 21 with the primary transfer roller 30. The color toner image is formed by overlapping Y (yellow), M (magenta), C (cyan) and K (black) toner images in order. The photoconductor cleaner 29 removes the toner remaining on the photoconductive drum 24 after the primary transfer.

The printer section 18 is provided with a secondary transfer roller 32. The secondary transfer roller 32 faces the backup roller 40 across the intermediate transfer belt 21. The secondary transfer roller 32 secondarily transfers the color toner image on the intermediate transfer belt 21 onto the sheet P entirely. The sheet P is fed from the paper feed apparatus 50 or a manual feed tray 17 along a conveyance path 33.

The printer section 18 is provided with a belt cleaner 43 facing the driven roller 41 across the intermediate transfer belt 21. The belt cleaner 43 removes the toner remaining on the intermediate transfer belt 21 after the secondary transfer.

The printer section 18 is provided with a register roller 33*a*, a fixing device 34 and a paper discharge roller 36 along the conveyance path 33. The printer section 18 is further provided with a bifurcation section 37 and a reverse conveyance section 38 at the downstream side of the fixing device 34. The bifurcation section 37 sends the sheet P after fixing to a sheet discharge section 20 or the reverse conveyance section 38. In the case of duplex printing, the reverse conveyance section 38 inverts the sheet P sent from the bifurcation section 37 to send it in the direction of the resist roller 33*a*. The MFP 10 forms a fixed toner image on the sheet P with the printer section 18 and then discharges it to the sheet discharge section 20.

Further, the MFP 10 is not limited to using a tandem developing system, and the number of the developing devices 28 therein is not limited. Alternatively, the MFP 10 may directly transfer the toner image from the photoconductive drum 24 onto the sheet P.

As stated above, the sheet P is conveyed from the paper feed apparatus 50 to the paper discharge section 20.

Hereinafter, in a conveyance direction V of the sheet P (hereinafter, referred to as a "sheet conveyance direction V"), the paper feed apparatus 50 side is set to an "upstream side". In the sheet conveyance direction V, the paper discharge section 20 side is set to a "downstream side".

Hereinafter, the paper feed apparatus 50 is described in detail.

Figure 2:
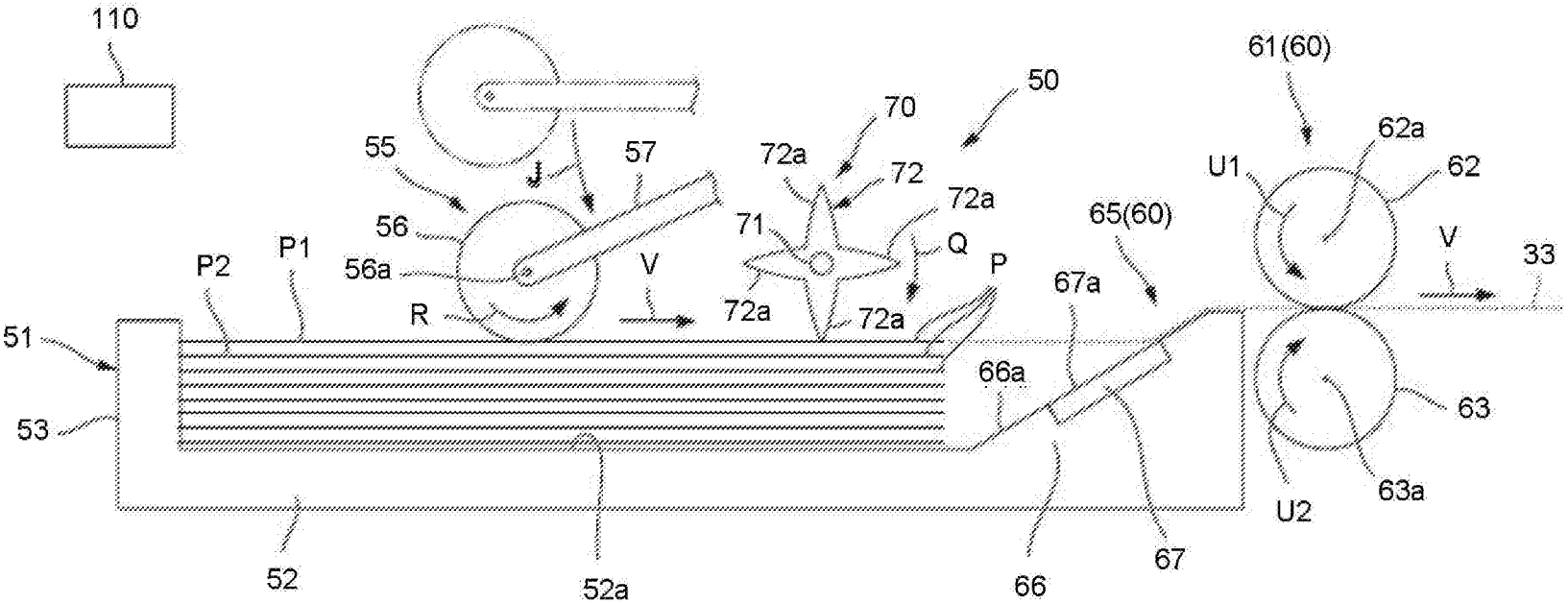
FIG. 2 is a side view illustrating an example of the schematic constitution of a paper feed apparatus according to the embodiment.

FIG. 2 is a side view illustrating an example of the schematic constitution of the paper feed apparatus 50 according to the embodiment.

As shown in FIG. 2, the paper feed apparatus 50 comprises a paper feed cassette 51, a delivery section 55, a separation section 60, a rotating body 70 and a control device 110.

First, the paper feed cassette 51 is described.

The paper feed cassette 51 houses a plurality of sheets P that is laminated (hereinafter, referred to as a "laminated sheet" in some cases). The paper feed cassette 51 is provided with a bottom wall 52 and a side wall 53.

The bottom wall 52 has a placing surface 52*a* on which the laminated sheet is placed. The placing surface 52*a* is flat substantially in parallel with a horizontal plane. An area of the placing surface 52*a* is larger than that of the sheet P.

The side wall 53 is arranged at a lateral side of the laminated sheet. In FIG. 2, the side wall 53 positioned at the upstream end of the bottom wall 52 is shown. The side wall 53 stands in a lamination direction of the laminated sheet. The height of the side wall 53 is higher than height of the laminated sheet. The side wall 53 is arranged at the lateral side of a sheet P that is initially sent out towards the conveyance path 33.

Next, the delivery section 55 is described.

The delivery section 55 is an example of a paper feed section for feeding the sheet P that is placed. The delivery section 55 sends out the plurality of the sheets P that is laminated in order towards the conveyance path 33. Specifically, the delivery section 55 sends out the plurality of the sheets P in order from a sheet P1 positioned at the uppermost side of the laminated sheet towards the conveying path 33. Hereinafter, the sheet P1 positioned at the uppermost side of the laminated sheet is referred to as a "first sheet P1" in some cases. The first sheet P1 is a sheet sent out towards the conveyance path 33 first. A sheet P2 that is sent out towards the conveyance path 33 next to the first sheet P1 is referred to as a "second sheet P2" in some cases.

The delivery section 55 is provided with the pickup roller 56 and a supporting member 57. The pickup roller 56 is formed into a cylindrical shape. For example, the pickup roller 56 is made of rubber. The pickup roller 56 is rotatable around a spindle 56*a*. The spindle 56*a* means a central axis (rotation axis) of the pickup roller 56. The spindle 56*a* has a length in a direction intersecting the sheet conveyance direction V. In the embodiment, the spindle 56*a* is substantially parallel to the horizontal direction and has a length in a width direction of the sheet P (hereinafter, referred to as a "sheet width direction") substantially orthogonal to the sheet conveyance direction V.

The supporting member 57 rotatably supports the pickup roller 56. The pickup roller 56 is driven by a rotating body (not shown) such as a belt and the like to rotate in an arrow R direction. The supporting member 57 is energized towards an arrow J direction by an energizing member (not shown) such as a spring in such a manner that the pickup roller 56 is energized towards the upper surface of the laminated sheet.

For example, the supporting member 57 swings up and down in conjunction with accommodation of the laminated sheet in the paper feed cassette 51. Specifically, if the paper feed cassette 51 is empty, the supporting member 57 moves upward against an energizing force of the energizing member to float the pickup roller 56 in the air. In other words, if the laminated sheet is not housed in the paper feed cassette 51, the supporting member 57 stops at a position shown by a two-dot chain line in FIG. 2. On the other hand, if the laminated sheet is housed in the paper feed cassette 51, the supporting member 57 moves downward (in an arrow J direction) by the energizing member to enable the pickup roller 56 to abut against the upper surface of the laminated sheet.

The separation section 60 is described.

The separation section 60 is arranged at the downstream side of the delivery section 55 in the sheet conveyance direction V. The separation section 60 separates a plurality of the sheets P that is overlapped in a case in which the plurality of the sheets P sent out from the delivery section 55 is overlapped. The separation section 60 is provided with a first separation section 61 and a second separation section 65.

The first separation section 61 is described.

The first separation section 61 is arranged at the downstream side of the delivery section 55 in the sheet conveyance direction V. The first separation section 61 includes a pair of rotating bodies 62 and 63 at least one of which is independently rotatable. The pair of the rotating bodies 62 and 63 respectively is rotatable around a plurality of rotating axes 62*a* and 63*a* substantially parallel to the spindle 56*a*. The pair of the rotating bodies 62 and 63 is arranged at positions that contribute to the formation of the conveyance path 33.

In the embodiment, the pair of the rotating bodies 62 and 63 is a paper feed roller 62 and a separation roller 63. The paper feed roller 62 and the separation roller 63 face each other across the conveyance path 33. The separation roller 63 is energized towards the paper feed roller 62 by an energizing member (not shown) such as a spring. The paper feed roller 62 and the separation roller 63 are respectively formed into a cylindrical shape. For example, the paper feed roller 62 and the separation roller 63 are rubber rollers. The outer shapes of the paper feed roller 62 and the separation roller 63 are substantially the same.

The paper feed roller 62 is arranged above the conveyance path 33. The paper feed roller 62 is rotatable around a first rotating axis 62*a* substantially parallel to the spindle 56*a*. The first rotating axis 62*a* means a central axis of the paper feed roller 62.

In the embodiment, the paper feed roller 62 is a drive roller connected to a drive section (not shown) such as a motor. The separation roller 63 contacts with the paper feed roller 62 to be driven by rotation of the paper feed roller 62.

The separation roller 63 is arranged below the conveyance path 33. The separation roller 63 is rotatable around a second rotating axis 63*a* substantially parallel to the spindle 56*a*. The second rotating axis 63*a* means a central axis of the separation roller 63.

Hereinafter, the rotation directions of the paper feed roller 62 and the separation roller 63 are described.

The paper feed roller 62 rotates in an arrow U1 direction by a drive section (not shown) such as a motor. In other words, the paper feed roller 62 rotates in the arrow U1 direction independently of the separation roller 63.

In a case in which the sheet P is not interposed between the paper feed roller 62 and the separation roller 63, the separation roller 63 is driven by the paper feed roller 62 to rotate in an arrow U2 direction. In other words, the separation roller 63 is driven to rotate by abutting against an outer peripheral surface of the paper feed roller 62 rotating in the arrow U1 direction.

For example, in a case in which one sheet P (i.e., the first sheet P1) is conveyed between the paper feed roller 62 and the separation roller 63, the first sheet P1 is conveyed towards the downstream side by the rotation of the paper feed roller 62. At this time, the separation roller 63 is driven to rotate by abutting against a lower surface of the first sheet P1 conveyed in the arrow V direction.

On the other hand, in a case in which two sheets P (i.e., the first sheet P1 and the second sheet P2) are conveyed between the paper feed roller 62 and the separation roller 63, only the first sheet P1 is conveyed towards the downstream side by the rotation of the paper feed roller 62. In a case in which two sheets P are inserted into a nip between the paper feed roller 62 and the separation roller 63, a driving force of the paper feed roller 62 does not reach the separation roller 63. If the driving force of the paper feed roller 62 does not reach the separation roller 63, the separation roller 63 stops rotating. If the separation roller 63 stops rotating, the first sheet P1 contacts with the paper feed roller 62. The first sheet P1 receives a force to be conveyed to the sheet conveyance direction V from the paper feed roller 62 by contacting with the paper feed roller 62. On the other hand, the separation roller 63 contacts with the second sheet P2 positioned below the first sheet P1. The separation roller 63 is formed by an elastic member with a friction force such as rubber. According to the above configuration, the separation roller 63 plays a role of a brake so that the second sheet P2 is not conveyed along with the first sheet P1. As the separation roller 63 plays the role of the brake, the two sheets P are separated and the first sheet P1 is first conveyed towards the downstream side.

The second separation section 65 is described.

The second separation section 65 is positioned between the delivery section 55 and the first separation section 61 in the sheet conveyance direction V. The second separation section 65 is provided with an inclined section 66 and a fixed friction section 67.

The inclined section 66 is arranged between the downstream end of the bottom wall 52 in the sheet conveyance direction V and the first separation section 61. The inclined section 66 has an inclined surface 66*a* which is inclined in such a manner that a downstream side part thereof in the sheet conveyance direction V is positioned at an upper side (first separation section 61 side). For example, the inclined section 66 is made of resin such as plastic.

The fixed friction section 67 is arranged at a vertically middle part of the inclined section 66. The fixed friction section 67 is arranged at a fixed position of the inclined section 66.

The fixed friction section 67 has a friction applying surface 67*a* inclined along the inclined surface 66*a* of the inclined section 66. The fixed friction section 67 applies a friction force to the sheet P sent out from the delivery section 55. For example, the fixed friction section 67 is a rubber member such as a rubber sheet. A coefficient of friction of the friction applying surface 67*a* in the fixed friction section 67 is greater than that of the inclined surface 66*a* in the inclined section 66. For example, the second separation section 65 is constituted by sticking a rubber sheet to the inclined section 66 made of resin.

The rotating body 70 is described.

The rotating body 70 is arranged at the upstream side of the separation section 60 in the sheet conveyance direction V. The rotating body 70 is capable of contacting with the sheet P that is placed. The rotating body 70 is rotatable by contacting with the upper surface of the laminated sheet.

The rotating body 70 in the embodiment is arranged at only the downstream side of the delivery section 55 in the sheet conveyance direction V. In other words, the rotating body 70 is not arranged at the upstream side of the delivery section 55 in the sheet conveyance direction V.

The rotating body 70 includes a rotating axis 71 and an abutting section 72.

The rotating axis 71 is rotatable at a position separated from the first sheet P1. In the embodiment, the rotating axis 71 is arranged above the laminated sheet. The rotating axis 71 has a length in a direction substantially parallel to the spindle 56*a*. The rotating axis 71 rotates in an arrow Q direction by a drive section (not shown) such as a motor.

The abutting section 72 is mounted on the rotating axis 71. The abutting section 72 can intermittently abut against the first sheet P1 by the rotation of the rotating axis 71. As seen from an axial direction of the rotating axis 71, the abutting section 72 is X-shaped. The abutting section 72 includes four projecting pieces 72*a* projecting outward in the radial direction of the rotating axis 71. The four projecting pieces 72*a* are arranged substantially at same interval in a circumferential direction of the rotating axis 71. The part of the projecting piece 72*a* outwards in the radial direction of the rotating axis 71 has a thin sharply pointed shape. For example, the projecting piece 72*a* is made of rubber.

Figure 3:
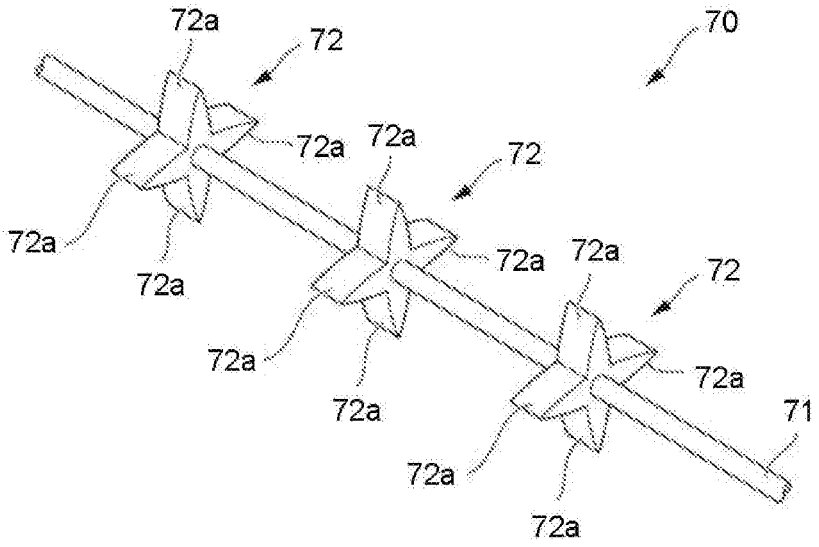
FIG. 3 is a perspective view illustrating an example of a rotating body according to the embodiment.

FIG. 3 is a perspective view illustrating an example of the rotating body 70 according to the embodiment.

As shown in FIG. 3, a plurality of the abutting sections 72 is arranged at intervals in a longitudinal direction of the rotating axis 71. In FIG. 3, an example is shown in which three abutting sections 72 are arranged in the longitudinal direction of the rotating axis 71. The interval between two adjacent abutting sections 72 are substantially the same.

An example (an example of the control by the control device 110) of the operation of the rotating body 70 is described.

Figure 4:
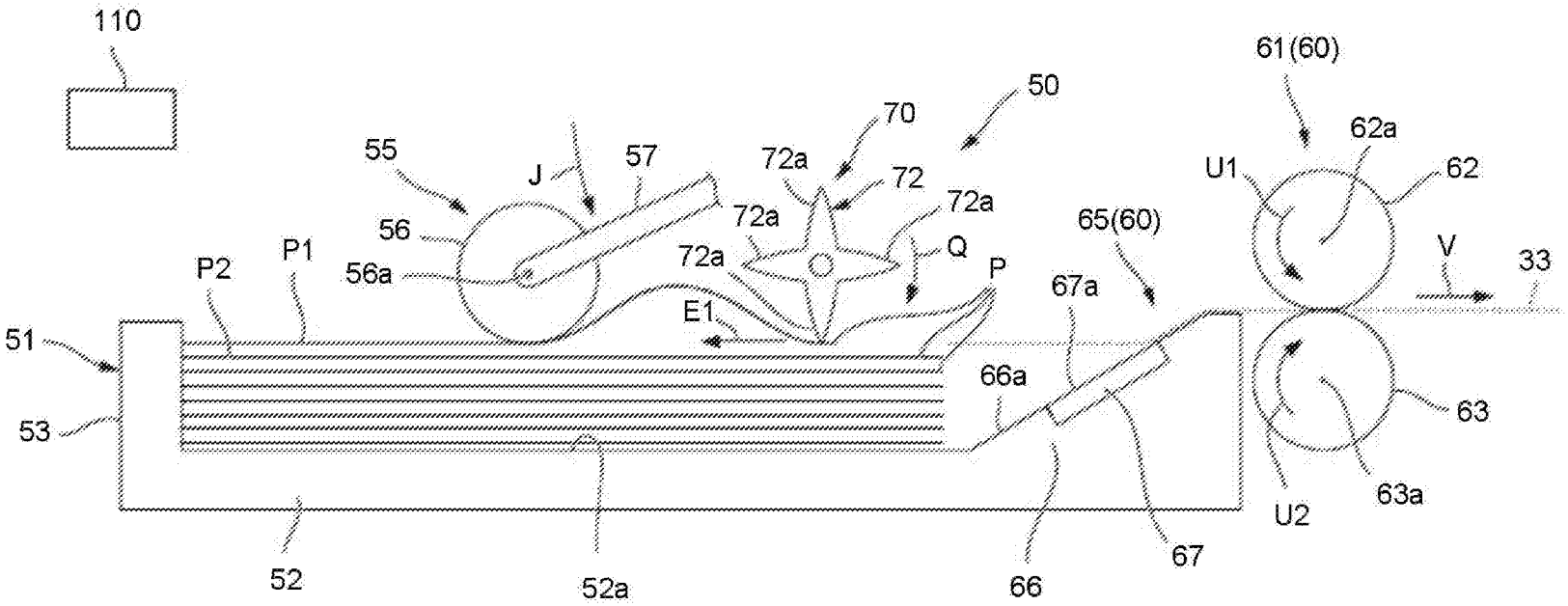
FIG. 4 is a view illustrating an example of the operation of the rotating body according to the embodiment.

FIG. 4 is a view illustrating an example of the operation of the rotating body 70 according to the embodiment. As shown in FIG. 4, the control device 110 carries out control to rotate the rotating body 70 at least before the operation of the delivery section 55. Specifically, the control device 110 enables the rotating body 70 to abut against the first sheet P1 to rotate in the arrow Q direction before the operation of the delivery section 55. At this time, the pickup roller 56 is energized in an arrow J direction towards the upper surface of the laminated sheet and stops. In the first sheet P1, a part abutting against the pickup roller 56 is pressed by an energizing force of the pickup roller 56. Further, in the first sheet P1, apart abutting against the front end of the projecting piece 72*a* of the rotating body 70 receives a force in an arrow E1 direction by the rotation of the rotating body 70. Thus, the first sheet P1 temporarily bends so that a convex is formed upward between the part abutting against the pickup roller 56 and the part abutting against the front end of the projecting piece 72*a* of the rotating body 70. The first sheet P1 temporarily bends, and in this way, air enters between the first sheet P1 and the second sheet P2. Thus, it is possible to sufficiently dispose the first sheet P1 and the second sheet P2.

Figure 5:
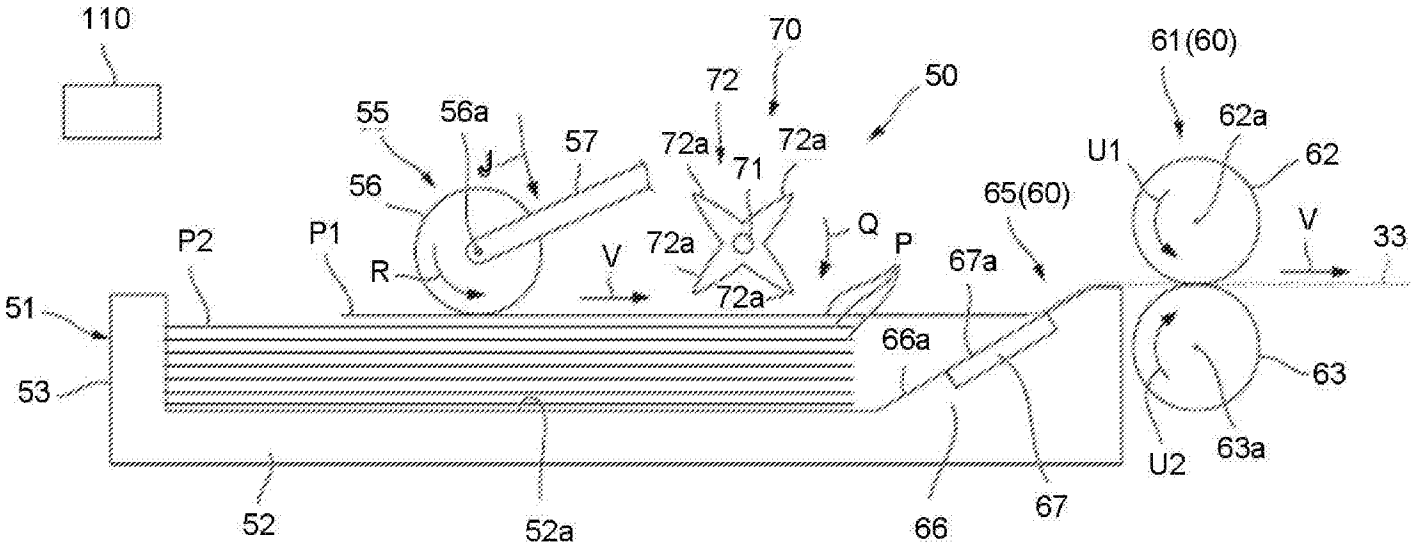
FIG. 5 is a view illustrating an example of the operation of the rotating body according to the embodiment following FIG. 4.

FIG. 5 is a view illustrating an example of the operation of the rotating body 70 according to the embodiment following FIG. 4.

As shown in FIG. 5, if the rotating body 70 further rotates in the arrow Q direction before the operation of the delivery section 55, the front end of the projecting piece 72*a* of the rotating body 70 is separated from the first sheet P1. At the time the front end of the projecting piece 72*a* is separated from the first sheet P1, the first sheet P1 is sent out towards the conveying path 33 by the operation of the delivery section 55. In other words, at the time the front end of the projecting piece 72*a* is separated from the first sheet P1, if the pickup roller 56 rotates in an arrow R direction, the first sheet P1 is conveyed in the arrow V direction. In FIG. 5, a state in which the first sheet P1 is separated from the second sheet P2 and is sent out toward the conveying path 33 is shown.

Figure 6:
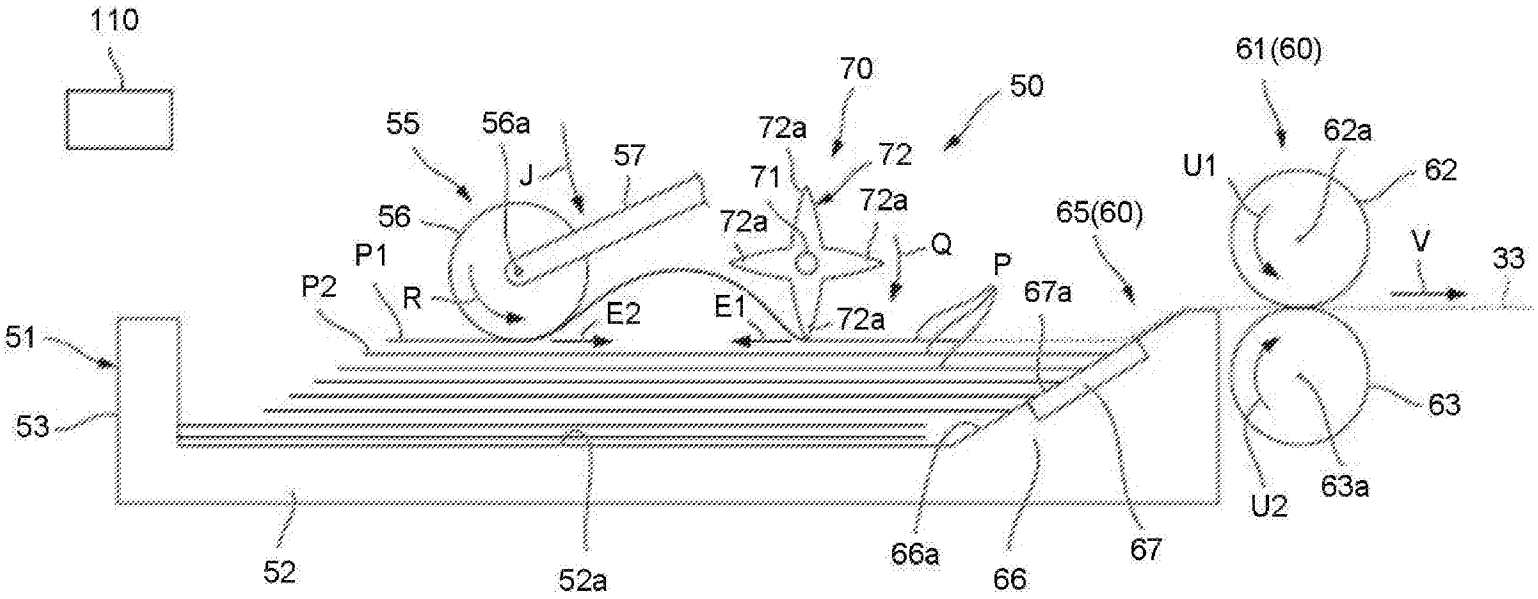
FIG. 6 is a view illustrating an example of the operation of the rotating body according to the embodiment following FIG. 5.

FIG. 6 is a view illustrating an example of the operation of the rotating body 70 according to the embodiment following FIG. 5.

As shown in FIG. 6, the control device 110 carries out control to rotate the rotating body 70 at the time the sheet P sent out from the delivery section 55 abuts against the fixed friction section 67. Specifically, the control device 110 enables the rotating body 70 to abut against the sheet P to rotate in the arrow Q direction at the time the sheet P sent out from the delivery section 55 abuts against the fixed friction section 67. At this time, the pickup roller 56 is energized towards the upper surface of the laminated sheet to rotate in the arrow R direction. The part abutting against the front end of the projecting piece 72*a* of the rotating body 70 in the first sheet P1 receives a force in the arrow E1 direction by the rotation of the rotating body 70 in the arrow Q direction. Further, the part abutting against the pickup roller 56 in the first sheet P1 receives a force in an arrow E2 direction by the rotation of the pickup roller 56 in the arrow R direction. Thus, the first sheet P1 temporarily bends in such a manner that a convex is formed upwards between the part abutting against the pickup roller 56 and the part abutting against the front end of the projecting piece 72*a* of the rotating body 70. The first sheet P1 temporarily bends, and in this way, the air enters between the first sheet P1 and the second sheet P2. Thus, it is possible to sufficiently dispose the first sheet P1 and the second sheet P2.

The functional components of the image forming apparatus 10 are described.

Figure 7:
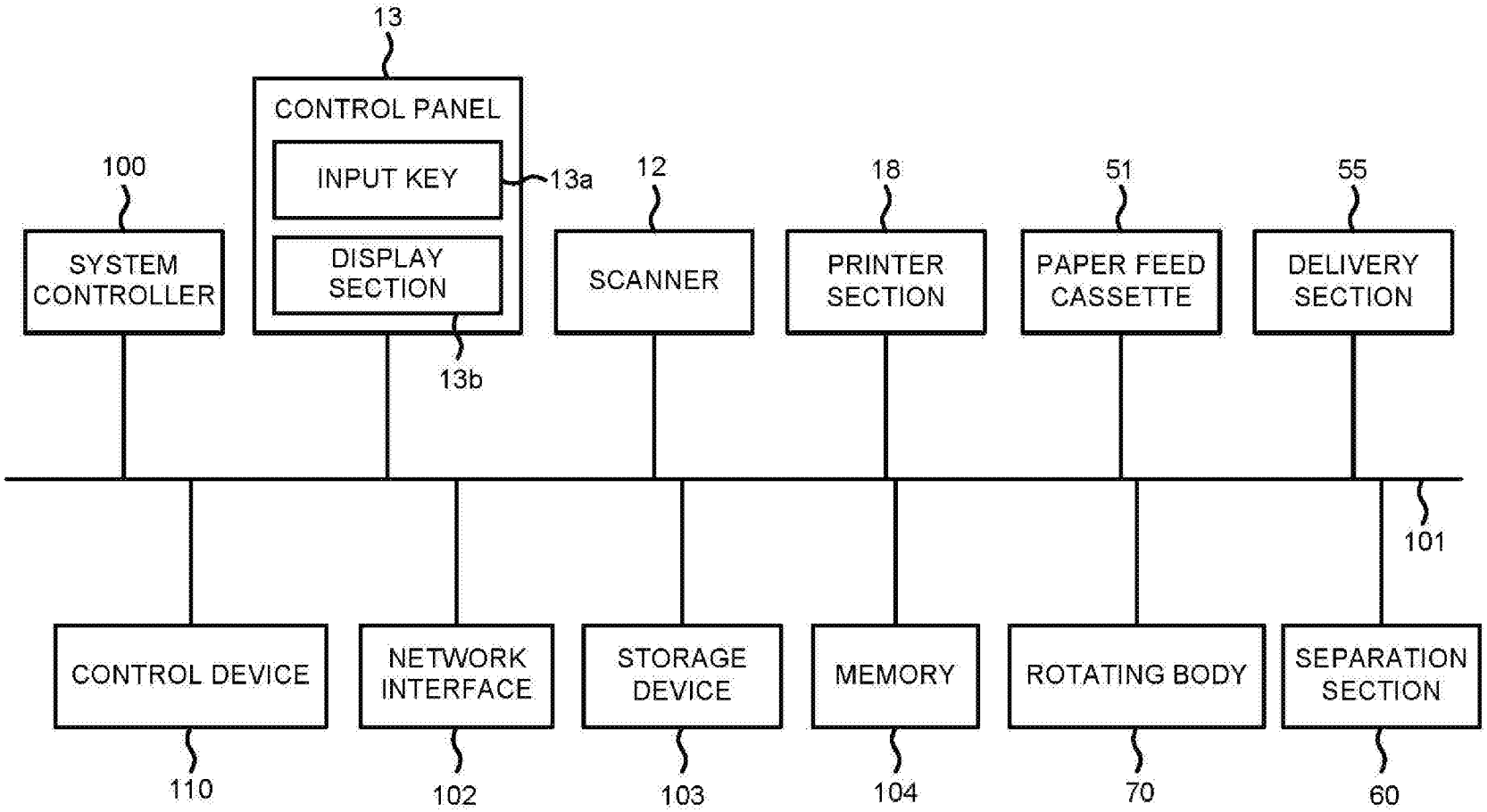
FIG. 7 is a block diagram illustrating an example of functional components of the image forming apparatus according to the embodiment.

FIG. 7 is a block diagram illustrating an example of functional components of the image forming apparatus 10 according to the embodiment.

As shown in FIG. 7, the functional sections of the image forming apparatus 10 are connected to be capable of carrying out data communication via a system bus 101.

The system controller 100 controls the operation of each functional section of the image forming apparatus 10. The system controller 100 executes various processing by executing programs. The system controller 100 acquires an instruction input by a user from the control panel 13. The system controller 100 executes a control processing based on the acquired instruction.

A network interface 102 transmits and receives data to and from other devices. The network interface 102 operates as an input interface to receive data transmitted from other devices. The network interface 102 also operates as an output interface to transmit data to other devices.

A storage device 103 stores various data. For example, the storage device 103 is a hard disk or an SSD (Solid State Drive). For example, various data includes digital data, screen data of a setting screen, setting information, job and a job log. The digital data is generated by the scanner 12 as an image reading section. The setting screen is used to carry out operation setting of the rotating body 70. The setting information relates to the operation setting of the rotating body 70.

A memory 104 temporarily stores data used by each functional section. For example, the memory 104 is a RAM (Random Access Memory). For example, the memory 104 temporarily stores digital data, a job and a job log.

The operation of the rotating body 70 in response to the type of the sheet P is described.

The system controller 100 controls the operation of the rotating body 70 according to the type of the sheet P. In a case in which the sheet is a sheet (hereinafter, referred to as a "sheet with low adhesion") that is difficult to adhere at the time the sheets P are laminated, the sheet P that is placed is fed (refer to FIG. 5) without operating the rotating body 70. In other words, in a case in which the sheet P is the sheet with low adhesion, the pickup roller 56 sends out the plurality of the sheets P that is overlapped in order towards the conveyance path 33 in a state in which the rotating body 70 is separated from the sheet P.

On the other hand, in a case in which the sheet is a sheet (hereinafter, referred to as "sheet with high adhesion") that is easy to adhere at the time the sheets P are laminated, the air enters between the first sheet P1 and the second sheet P2 (refer to FIG. 6) by operating the rotating body 70 with input keys 13*a* such as buttons or the like. For example, in a case in which the sheet P is the sheet with high adhesion, by pressing the button by the user, the rotating body 70 may be rotated to switch to the state shown in FIG. 6.

If the rotating body 70 is not included, due to the coefficient of friction between the sheets P and the surface state of the sheet P, there is a case in which the plurality of the sheets P that is overlapped cannot be disposed by the fixed friction section 67.

The surface state of the sheet P contains roughness of the surface of the sheet P. As other factors why the plurality of the sheets P that is overlapped cannot be disposed by the fixed friction section 67, external factors such as humidity and temperature, static electricity between the sheets P, and the storage time of the laminated sheet are exemplified.

If the plurality of the sheets P that is overlapped is conveyed to the pair of rollers 62 and 63, there is a possibility that the plurality of the sheets P cannot be separated by the separation roller 63 and the double feeding occurs. Hereinafter, the constitution in which the rotating body 70 is not included is set as a "comparative embodiment".

Figure 8:
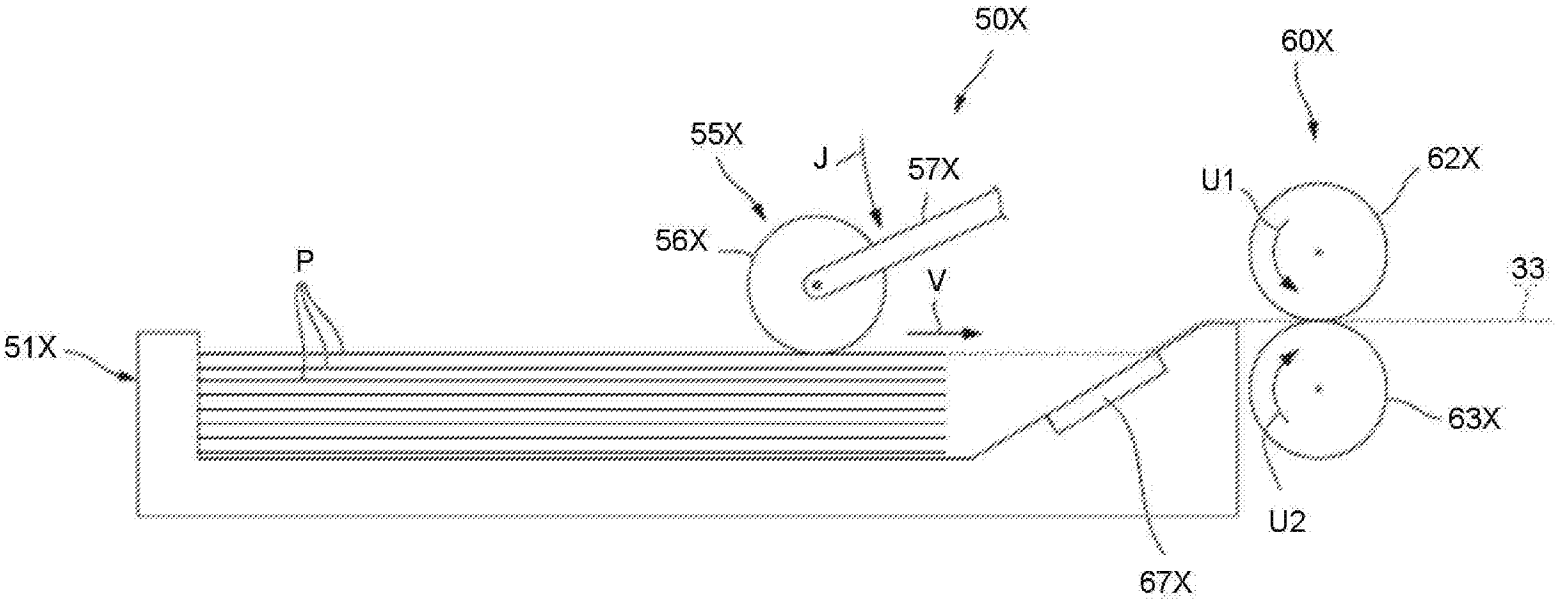
FIG. 8 is a side view illustrating an example of functional components of a paper feed apparatus according to a comparative embodiment.

FIG. 8 is a side view illustrating an example of functional components of a paper feed apparatus 50X according to the comparative embodiment.

As shown in FIG. 8, the paper feed apparatus 50X according to the comparative embodiment includes a paper feed cassette 51X, a delivery section 55X and a separation section 60X. The paper feed apparatus 50X according to the comparative embodiment does not include the rotating body 70 (refer to FIG. 2) of the embodiment. In FIG. 8, a pickup roller 56X is energized in the arrow J direction towards the upper surface of the laminated sheet and stops.

Figure 9:
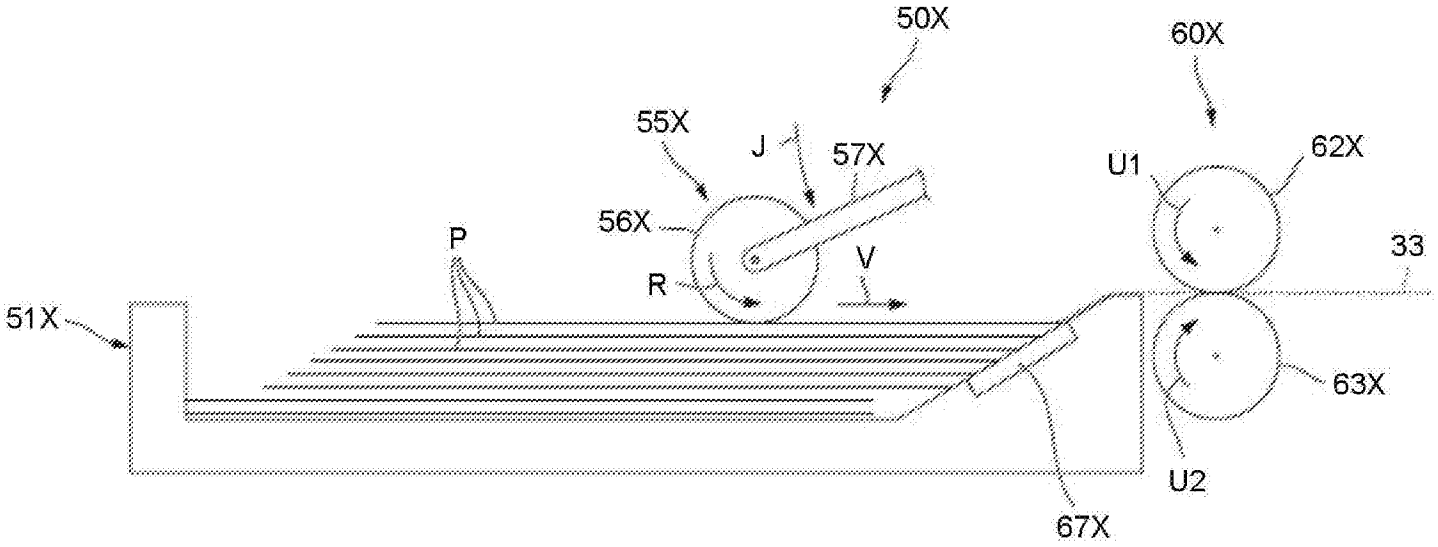
FIG. 9 is a view illustrating a principle of occurrence of a double feeding.

FIG. 9 is a view illustrating a principle of the occurrence of the double feeding.

As shown in FIG. 9, the pickup roller 56X rotates in an arrow R direction by being energized in the arrow J direction towards the upper surface of the laminated sheet. The pickup roller 56X feeds the plurality of the sheets P that is overlapped in order towards the conveyance path 33. Due to the coefficient of friction between the sheets P and the surface state of the sheet P, the plurality of the sheets P that is overlapped is inclined in such a manner that the upper side thereof is positioned at the downstream side in the sheet conveyance direction V.

Figure 10:
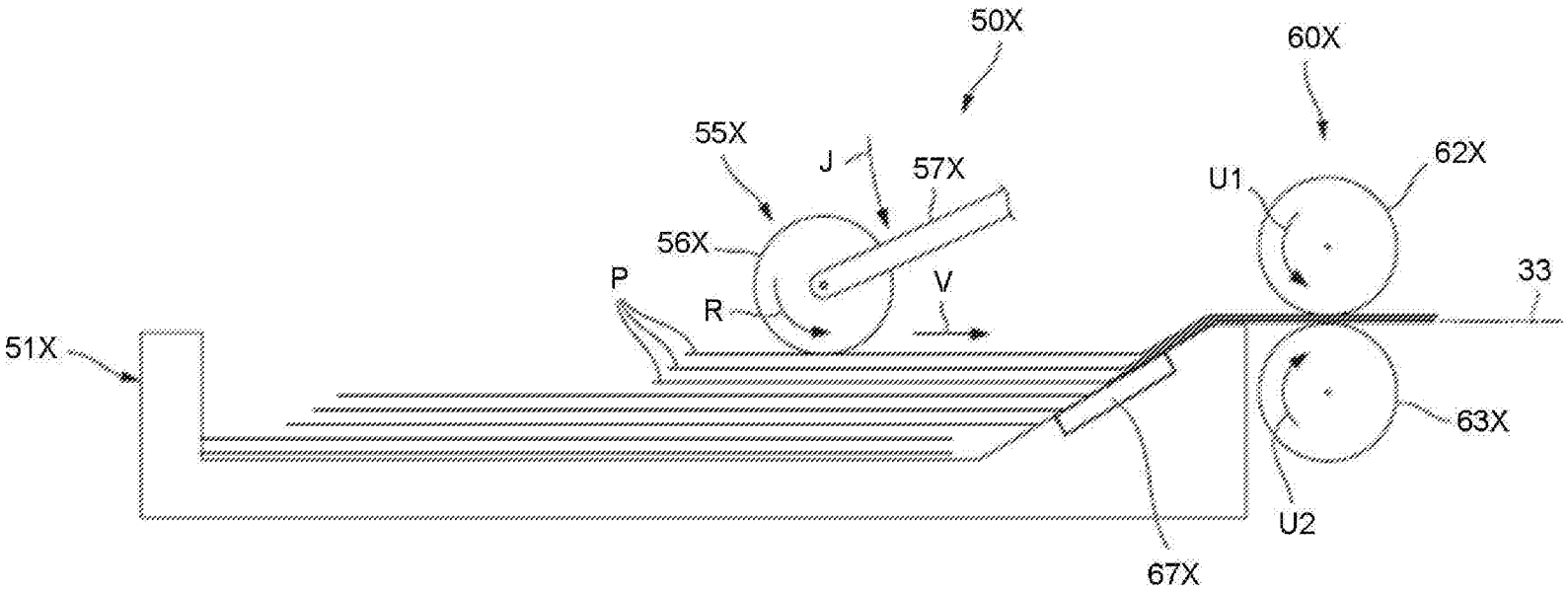
FIG. 10 is a view illustrating the principle of occurrence of the double feeding following FIG. 9.

FIG. 10 is a view illustrating the principle of the occurrence of the double feeding following FIG. 9.

As shown in FIG. 10, due to the coefficient of friction between the sheets P and the surface state of the sheet P, there is a case in which the plurality of the sheets P that is overlapped cannot be disposed by a fixed friction section 67X. For example, in a case in which an adhesion force of the plurality of the sheets P is greater than a friction force applied to the sheet P by the fixed friction section 67X, the plurality of the sheets P that is overlapped cannot be disposed by the fixed friction section 67X.

As stated above, if the plurality of the sheets P that is overlapped cannot be disposed by the fixed friction section 67X, the plurality of the sheets P that is overlapped is conveyed to a pair of rollers 62X and 63X. In this way, there is a possibility that the plurality of the sheets P cannot be separated by the separation roller 63X and the double feeding occurs.

According to the embodiment, the paper feed apparatus 50 includes the delivery section 55, the separation section 60, the rotating body 70 and the control device 110. The delivery section 55 sends out the plurality of the sheets P that is overlapped in order towards the conveyance path 33. The separation section 60 is arranged at the downstream side of the delivery section 55 in the sheet conveyance direction V. The separation section 60 separates the plurality of the sheets P that is overlapped in a case in which the plurality of the sheets P sent out from the delivery section 55 is overlapped. The rotating body 70 is arranged at the upstream side of the separation section 60 in the sheet conveyance direction V. The rotating body 70 is capable of contacting with the sheet P that is placed. The rotating body 70 is rotatable. The control device 110 carries out control to rotate the rotating body 70 at least before the operation of the delivery section 55. With the above constitution, the following effect is achieved. The rotating body 70 abuts against the first sheet P1 to rotate before the operation of the delivery section 55, and in this way, the first sheet P1 can be temporarily bent before the operation of the delivery section 55. Through temporary bending of the first sheet P1, since the air enters between the first sheet P1 and the second sheet P2, the first sheet P1 and the second sheet P2 can be disposed. Thus, it is possible to suppress the occurrence of the double feeding.

From the viewpoint of reducing the cost of the sheet P, a recycled paper may be used as the sheet P instead of a plain paper. However, in a case of using the recycled paper as the sheet P, since fibers of the recycled paper are shorter than the plain paper and easy to untwist at the edge of the sheet, the possibility increases that the untwisted fibers are tangled with each other and are double fed. According to the embodiment, even if the recycled paper is used as the sheet P, since the first sheet P1 and the second sheet P2 can be disposed before the operation of the delivery section 55, the double feeding can be suppressed.

The rotating body 70 is arranged at the downstream side of the delivery section 55 in the sheet conveyance direction V, and the following effect is achieved. At the downstream side of the delivery section 55 in the sheet conveyance direction V, since the air enters between the first sheet P1 and the second sheet P2, the first sheet P1 and the second sheet P2 can be disposed. Thus, it is preferable to arrange the rotating body 70 at the downstream side of the delivery section 55 in the sheet conveyance direction V in a case in which the adhesion between the first sheet P1 and the second sheet P2 is relatively high.

The rotating body 70 includes the rotating axis 71 and the abutting section 72. The rotating axis 71 is rotatable at a position separated from the first sheet P1. The abutting section 72 can intermittently abut against the first sheet P1 by the rotation of the rotating axis 71. With the above constitution, the following effect is achieved. It is conceivable that the rotating body that is rotatable by abutting against the sheet P is set to a cylindrical roller (hereinafter, referred to as a "cylindrical roller"). However, if the rotating body is set to the cylindrical roller, since the outer peripheral surface of the cylindrical roller always abuts against the first sheet P1 during the rotation of the cylindrical roller, it is necessary to separately arrange a lifting mechanism of the cylindrical roller. According to the embodiment, since the abutting section 72 can intermittently abut against the first sheet P1 by the rotation of the rotating axis 71, it is unnecessary to separately arrange the lifting mechanism. Thus, it is possible to simplify the configuration of the device as compared with the case in which the rotating body is the cylindrical roller.

The separation section 60 includes the first separation section 61 and the second separation section 65. The first separation section 61 is positioned at the downstream side of the delivery section 55 in the sheet conveyance direction V. The second separation section 65 is positioned between the delivery section 55 and the first separation section 61 in the sheet conveyance direction V. With the above constitution, the following effect is achieved. If the plurality of the sheets P sent out from the delivery section 55 is overlapped, the plurality of the sheets P that is overlapped can be separated by two stages of the first separation section 61 and the second separation section 65. Thus, the occurrence of the double feeding can be further suppressed as compared with a case in which the separation section 60 is provided with only one separation section.

The first separation section 61 includes a pair of rotating bodies 62 and 63 at least one of which is independently rotatable. The second separation section 65 is provided with the fixed friction section 67 which is fixed at a fixed position and applies the friction force to the sheet P sent out from the delivery section 55. With the above constitution, the following effect is achieved. If the plurality of the sheets P sent out from the delivery section 55 is overlapped, the plurality of the sheets P that is overlapped can be separated by the fixed friction section 67. In addition, if the plurality of the sheets P sent from the fixed friction section 67 is overlapped, the plurality of the sheets P that is overlapped can be separated by the pair of rotating bodies 62 and 63. If only two sheets P are overlapped, it is possible to reliably separate the two sheets P that are overlapped with the pair of the rotating bodies 62 and 63. For example, in a case in which two sheets P (i.e., the first sheet P1 and the second sheet P2) are conveyed between the paper feed roller 62 and the separation roller 63, by the rotation of the paper feed roller 62, only the first sheet P1 can be conveyed towards the downstream side. At this time, the separation roller 63 abuts against the lower surface of the second sheet P2 to separate the second sheet P2 from the first sheet P1.

The control device 110 carries out control to rotate the rotating body 70 at the time the sheet P sent out from the delivery section 55 abuts against the fixed friction section 67, and in this way, the following effect is achieved. The sheet P can be disposed in two stages, that is, before the operation of the delivery section 55 and at the time the sheet P abuts against the fixed friction section 67. Thus, the occurrence of the double feeding can be further suppressed as compared with a case in which the sheet P is disposed only before the operation of the delivery section 55. In addition, the sheet P is disposed at the time the sheet P abuts against the fixed friction section 67, and in this way, the plurality of the sheets P that is overlapped can be easily separated by the fixed friction section 67.

Hereinafter, modifications are described.

First, a first modification of the embodiment is described.

Figure 11:
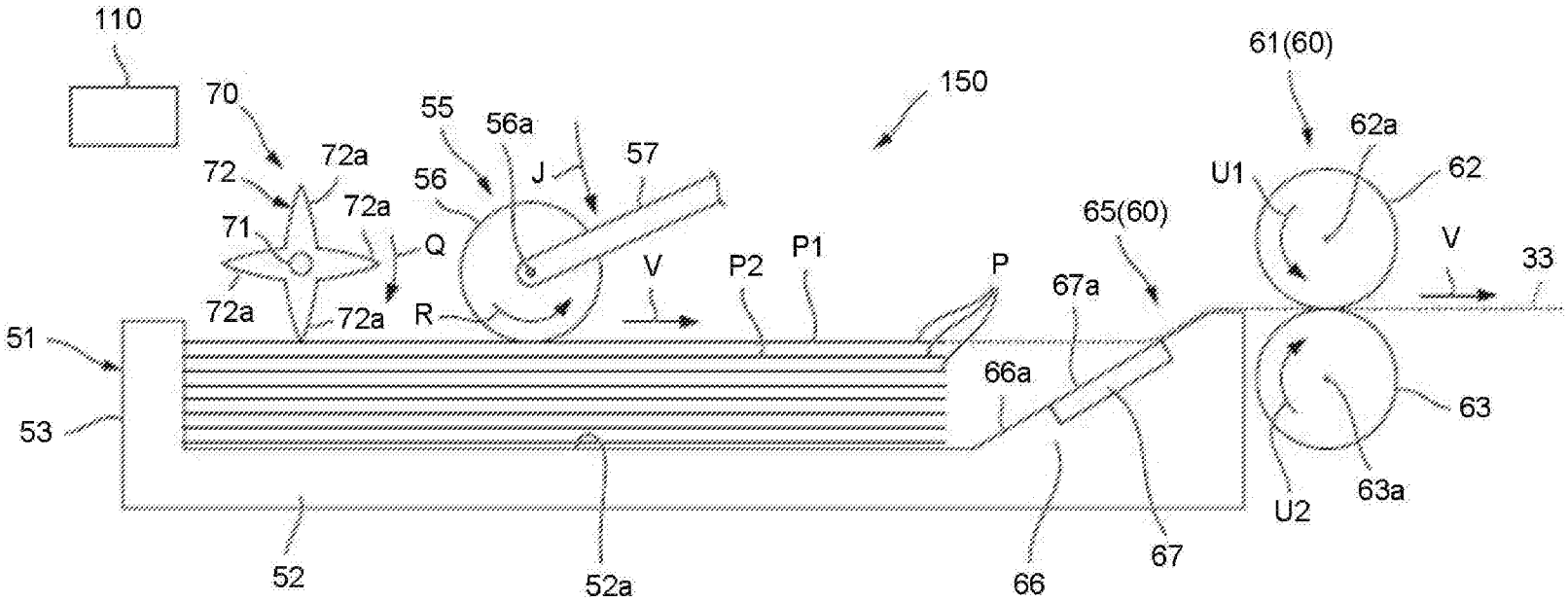
FIG. 11 is aside view illustrating an example of functional components of a paper feed apparatus according to a first modification of the embodiment.

The rotating body 70 is not limited to only being arranged at the downstream side of the delivery section 55 in the sheet conveyance direction V. FIG. 11 is a side view illustrating an example of functional components of a paper feed apparatus 150 according to the first modification of the embodiment. As shown in FIG. 11, the rotating body 70 may be arranged only at the upstream side of the delivery section 55 in the sheet conveyance direction V. In the present modification, the control device 110 carries out control to rotate the rotating body 70 towards the side wall 53. The controlling device 110 rotates the rotating body 70 in the arrow Q direction towards the side wall 53 at the time the rotating body 70 abuts against the first sheet P1 to rotate before the operation of the delivery section 55. Alternatively, the control device 110 rotates the rotating body 70 in a direction (counterclockwise) opposite to the arrow Q direction (clockwise) towards the pickup roller 56 at the time the rotating body 70 abuts against the first sheet P1 to rotate before the operation of the delivery section 55.

According to the first modification, since the air enters between the first sheet P1 and the second sheet P2 at the upstream side of the delivery section 55 in the sheet conveyance direction V, the first sheet P1 and the second sheet P2 can be disposed. Therefore, it is preferable to arrange the rotating body 70 at the upstream side of the delivery section 55 in the sheet conveyance direction V if the adhesion between the first sheet P1 and the second sheet P2 is relatively high.

A second modification of the embodiment is described.

Figure 12:
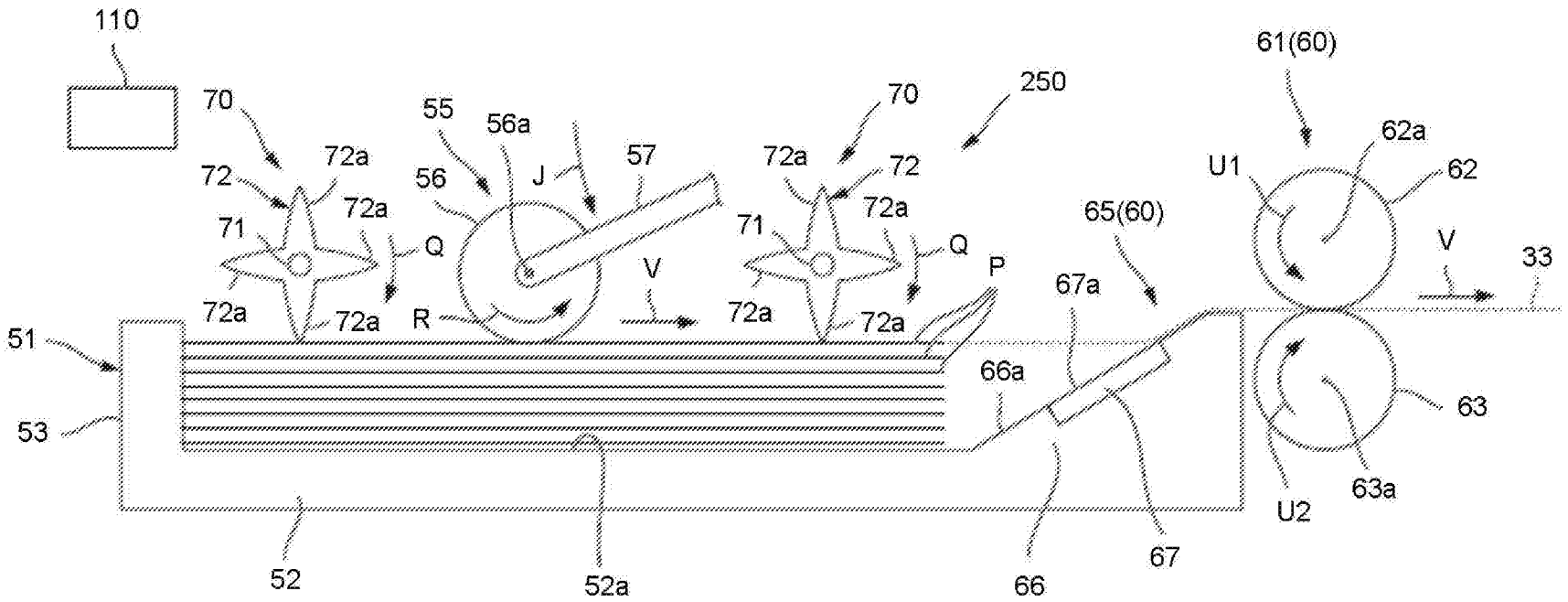
FIG. 12 is aside view illustrating an example of functional components of a paper feed apparatus according to a second modification of the embodiment.

FIG. 12 is aside view illustrating an example of functional components of a paper feed apparatus 250 according to the second modification of the embodiment. As shown in FIG. 12, the rotating bodes 70 may be respectively arranged at the upstream side and the downstream side of the delivery section 55 in the sheet conveyance direction V.

According to the second modification, as compared with a case in which the rotating body 70 is arranged at either the upstream side or the downstream side of the delivery section 55 in the sheet conveyance direction V, the first sheet P1 can be greatly bent. The first sheet P1 is greatly bent, and in this way, the air enters between the first sheet P1 and the second sheet P2 entirely. Thus, the first sheet P1 and the second sheet P2 can be further disposed. Therefore, the occurrence of the double feeding can be further suppressed.

A third modification of the embodiment is described.

Figure 13:
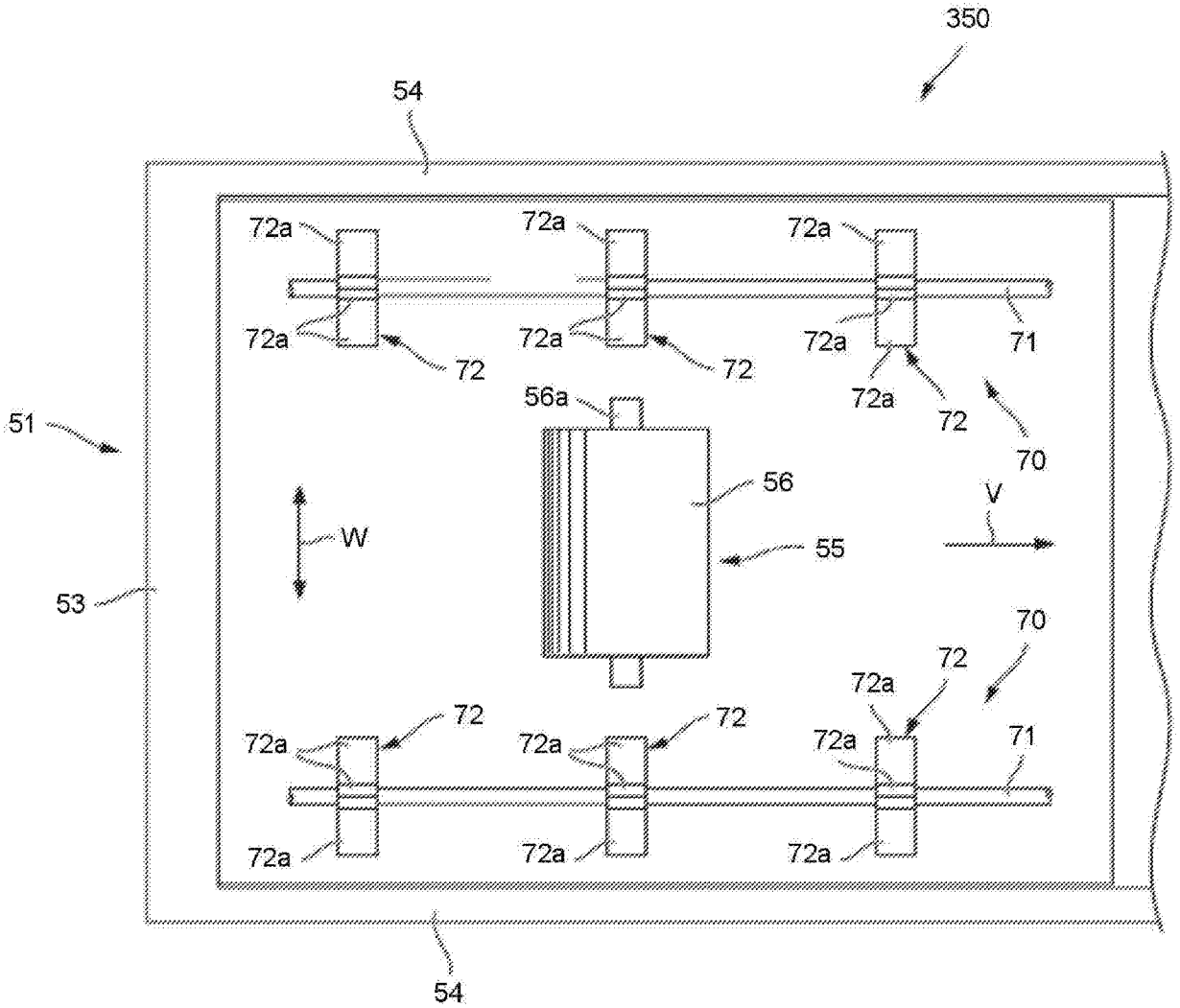
FIG. 13 is a top view illustrating an example of functional components of a paper feed apparatus according to a third modification of the embodiment.

FIG. 13 is a top view illustrating an example of functional components of a paper feed apparatus 350 according to the third modification of the embodiment. As shown in FIG. 13, the rotating bodies 70 may be arranged respectively at both one side and the other side of the delivery section 55 in the sheet width direction. In FIG. 13, the sheet width direction is shown by an arrow W direction. In FIG. 13, the upstream ends of a pair of side walls 54 are connected with the side wall 53 and the pair of side walls 54 is positioned at two sides of the laminated sheet in the sheet width direction W. The pair of side walls 54 stands towards a lamination direction of the laminated sheet.

According to the third modification, at the one side and the other side of the delivery section 55 in the sheet width direction W, since the air enters between the first sheet P1 and the second sheet P2, the first sheet P1 and the second sheet P2 can be disposed. Thus, it is preferable to arrange the rotating bodies 70 at both sides of the delivery section 55 in the sheet width direction W if the adhesion between the first sheet P1 and the second sheet P2 is relatively high.

The rotating body 70 may be arranged at only one side of the delivery section 55 in the sheet width direction W. The rotating body 70 may be arranged at the other side of the delivery section 55 in the sheet width direction W. The rotating body 70 may be arranged at least one of the one side and the other side of the delivery section 55 in the sheet width direction W.

Other modifications of the embodiment are described.

Figure 14:
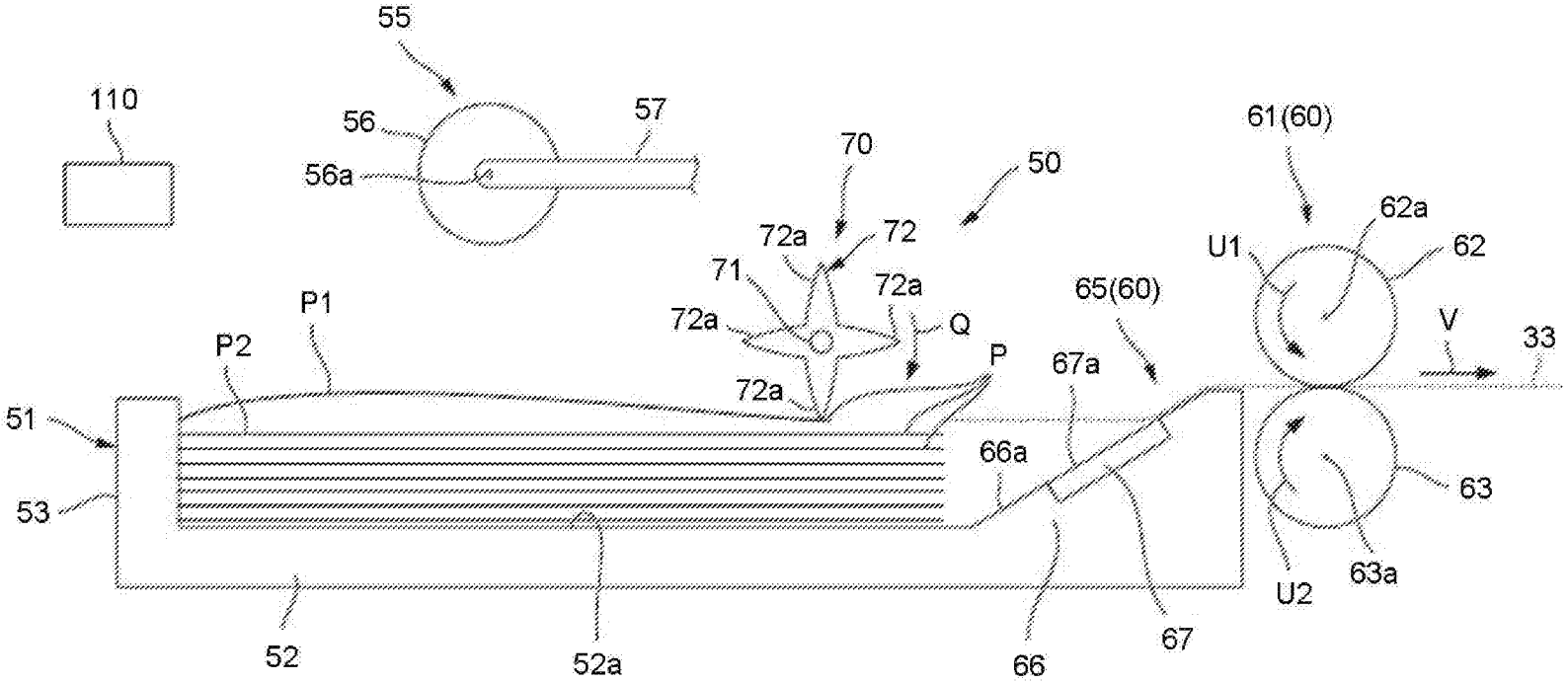
FIG. 14 is a view illustrating another example of the operation of the rotating body according to the embodiment.

FIG. 14 is a view illustrating another example of the operation of the rotating body 70 according to the embodiment.

As shown in FIG. 14, the rotating body 70 is arranged at a position separated from the side wall 53 of the paper feed cassette 51. The rotating body 70 is positioned above the downstream side end of the laminated sheet in the sheet conveyance direction V. The control device 110 carries out control to rotate the rotating body 70 towards the side wall 53. Specifically, the control device 110 rotates the rotating body 70 in the arrow Q direction towards the side wall 53 at the time the rotating body 70 rotates by abutting against the first sheet P1 before the operation of the delivery section 55.

For example, a supporting member 57 swings up and down in conjunction with the operation of the rotating body 70. Specifically, before the operation of the rotating body 70, the supporting member 57 moves upward against an energizing force of an energizing member to support the pickup roller 56 in a state of floating the pickup roller 56 in the air. Before the operation of the rotating body 70, the supporting member 57 stops at a position shown in FIG. 14. On the other hand, during the operation of the rotating body 70, the supporting member 57 moves downward (arrow J direction shown in FIG. 2) by the energizing member, to enable the pickup roller 56 to abut against the upper surface of the laminated sheet.

According to the present modification, as compared with a case in which the rotating body 70 is arranged based on the delivery section 55, the first sheet P1 can be greatly bent between the side wall 53 and the rotating body 70 in the sheet conveyance direction V. The first sheet P1 is greatly bent, and in this way, the air enters between the first sheet P1 and the second sheet P2 entirely. Thus, the first sheet P1 and the second sheet P2 can be further disposed. Therefore, the occurrence of the double feeding can be further suppressed.

The control device 110 is not limited to rotating the rotating body 70 by abutting against the sheet P at the time the sheet P sent out from the delivery section 55 abuts against the fixed friction section 67. For example, the control device 110 may separate the rotating body 70 from the sheet P at the time the sheet P sent out from the delivery section 55 abuts against the fixed friction section 67. In other words, the control device 110 may carry out control to rotate the rotating body 70 at least before the operation of the delivery section 55.

As seen from an axial direction of the rotating axis 71, the abutting section 72 is not limited to an X shape. For example, as seen from the axial direction of the rotating axis 71, the abutting section 72 may have a polygonal shape such as a triangular shape or a quadrangular shape, or may have an elliptical shape. The abutting section 72 may be formed into any shape as long as it can intermittently abut against the first sheet P1 by the rotation of the rotating axis 71.

The abutting section 72 is not limited to having four projecting pieces 72*a* projecting outward in the radial direction of the rotating axis 71. For example, the number of the projecting piece 72*a* may be only one, two or three. The number of the projecting piece 72*a* can be properly changed.

The fixed friction section 67 is not limited to having the friction applying surface 67*a* inclined along the inclined surface 66*a* of the inclined section 66. For example, the fixed friction section 67 may be formed into a stepwise shape inclined along the inclined surface 66*a* of the inclined section 66.

According to at least one embodiment described above, the paper feed apparatus 50 includes the delivery section 55, the separation section 60, the rotating body 70 and the control device 110. The delivery section 55 sends out the plurality of the sheets P that is overlapped in order towards the conveyance path 33. The separation section 60 is arranged at the downstream side of the delivery section 55 in the sheet conveyance direction V. The separation section 60 separates the plurality of the sheets P that is overlapped in a case in which the plurality of the sheets P sent out from the delivery section 55 is overlapped. The rotating body 70 is arranged the upstream side of the separation section 60 in the sheet conveyance direction V. The rotating body 70 is capable of contacting with the sheet P that is placed. The rotating body 70 is rotatable. The control device 110 carries out control to rotate the rotating body 70 at least before the operation of the delivery section 55. With the above constitution, the following effect is achieved. The rotating body 70 abuts against the first sheet P1 to rotate before the operation of the delivery section 55, and in this way, the first sheet P1 can be temporarily bent before the operation of the delivery section 55. Since the air enters between the first sheet P1 and the second sheet P2 through temporary bending of the first sheet P1, the first sheet P1 and the second sheet P2 can be disposed. Thus, it is possible to suppress the occurrence of the double feeding.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A paper feed apparatus, comprising:

a paper feed section defining a conveyance direction of a first sheet;

a first separation section positioned at the downstream side of the paper feed section in the conveyance direction of an image receiving medium;

a second separation section positioned between the paper feed section and the first separation section in the conveyance direction of the image receiving medium;

a rotating body configured to contact and move the first sheet in a direction substantially opposite to the conveyance direction to temporarily bend the first sheet, allowing air to enter between the first sheet and a second sheet positioned underneath the first sheet; and a plurality of rotating bodies respectively arranged at both the upstream side and the downstream side of the paper feed section in the conveyance direction of the image receiving medium.

2. The paper feed apparatus according to claim 1, wherein the rotating body comprises a rotating axis that is rotatable at a position separated from a placed image receiving medium, and an abutting section capable of intermittently abutting against the placed image receiving medium by a rotation of the rotating axis.

3. The paper feed apparatus according to claim 1, wherein the first separation section comprises a pair of rotating bodies at least one of which is independently rotatable, and the second separation section comprises a fixed friction section fixed at a fixed position to apply a friction force to the image receiving medium fed from the paper feed section.

4. An image forming apparatus, comprising:

an image forming section configured to form an image on an image receiving medium; and a paper feed apparatus configured to feed the image receiving medium towards the image forming section, the paper feed apparatus, comprising a paper feed section defining a conveyance direction of a first sheet, a first separation section positioned at the downstream side of the paper feed section in the conveyance direction of the image receiving medium, a second separation section positioned between the paper feed section and the first separation section in the conveyance direction of the image receiving medium, a rotating body configured to contact and move the first sheet in a direction substantially opposite to the conveyance direction to temporarily bend the first sheet, allowing air to enter between the first sheet and a second sheet positioned underneath the first sheet, and a plurality of rotating bodies respectively arranged at both the upstream side and the downstream side of the paper feed section in the conveyance direction of the image receiving medium.

5. The image forming apparatus according to claim 4, wherein the plurality of rotating bodies are arranged at either an upstream side or a downstream side of the paper feed section in the conveyance direction of the image receiving medium.

6. A paper feed apparatus, comprising:

a paper feed section defining a conveyance direction of a first sheet;

a first separation section positioned at the downstream side of the paper feed section in the conveyance direction of an image receiving medium;

a second separation section positioned between the paper feed section and the first separation section in the conveyance direction of the image receiving medium; and a rotating body configured to contact and move the first sheet in a direction substantially opposite to the conveyance direction to temporarily bend the first sheet, allowing air to enter between the first sheet and a second sheet positioned underneath the first sheet, wherein the rotating body is arranged at an upstream side of the paper feed section in the conveyance direction of the image receiving medium.

7. The paper feed apparatus according to claim 6, further comprising a plurality of rotating bodies respectively arranged at both the upstream side and the downstream side of the paper feed section in the conveyance direction of the image receiving medium.

8. The paper feed apparatus according to claim 7, wherein the plurality of rotating bodies are arranged in at least one of one side and the other side of the paper feed section in a width direction of the image receiving medium intersecting with the conveyance direction of the image receiving medium.

9. The paper feed apparatus according to claim 6, wherein the rotating body comprises a rotating axis that is rotatable at a position separated from a placed image receiving medium, and an abutting section capable of intermittently abutting against the placed image receiving medium by a rotation of the rotating axis.

10. The paper feed apparatus according to claim 6, wherein the first separation section comprises a pair of rotating bodies at least one of which is independently rotatable, and the second separation section comprises a fixed friction section fixed at a fixed position to apply a friction force to the image receiving medium fed from the paper feed section.

11. The paper feed apparatus according to claim 10, wherein a control device rotates the rotating body at a time the image receiving medium fed from the paper feed section abuts against the fixed friction section.

12. The paper feed apparatus according to claim 11, further comprising:

a paper feed cassette configured to house the image receiving medium, the paper feed cassette comprises a side wall arranged at a lateral side of the image receiving medium, wherein the rotating body is arranged at a position separated from the side wall, and the control device rotates the rotating body towards the side wall.

* * * * *